US008690555B2

(12) United States Patent
Ogata et al.

(10) Patent No.: US 8,690,555 B2
(45) Date of Patent: Apr. 8, 2014

(54) TWO-STAGE ROTARY EXPANDER, EXPANDER-COMPRESSOR UNIT, AND REFRIGERATION CYCLE APPARATUS

(75) Inventors: Takeshi Ogata, Osaka (JP); Hidetoshi Taguchi, Osaka (JP); Hiroshi Hasegawa, Osaka (JP); Yasufumi Takahashi, Osaka (JP); Atsuo Okaichi, Osaka (JP)

(73) Assignee: Panasonic Corporation, Osaka (JP)

( * ) Notice: Subject to any disclaimer, the term of this patent is extended or adjusted under 35 U.S.C. 154(b) by 1198 days.

(21) Appl. No.: 12/528,512

(22) PCT Filed: Feb. 22, 2008

(86) PCT No.: PCT/JP2008/000315

§ 371 (c)(1),
(2), (4) Date: Aug. 25, 2009

(87) PCT Pub. No.: WO2008/108062

PCT Pub. Date: Sep. 12, 2008

(65) Prior Publication Data

US 2010/0043481 A1 Feb. 25, 2010

(30) Foreign Application Priority Data

Mar. 1, 2007 (JP) ..... 2007-051002

(51) Int. Cl.

| | |
|---|---|
| ***F01C 1/30*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/3; 418/55.1; 418/60; 418/65; 418/249

(58) Field of Classification Search

USPC ..... 418/3, 5, 55.1–55.6, 57, 58, 60, 61.1, 418/65, 209, 249

See application file for complete search history.

(56) References Cited

U.S. PATENT DOCUMENTS

| | | | | |
|---|---|---|---|---|
| 5,775,883 | A | 7/1998 | Hattori et al. | |
| 8,056,361 | B2 * | 11/2011 | Matsui et al. | 418/60 |
| 2007/0053782 | A1 | 3/2007 | Okamoto et al. | |
| 2009/0178433 | A1 | 7/2009 | Kumakura et al. | |
| 2009/0229302 | A1 * | 9/2009 | Hasegawa et al. | 62/498 |

FOREIGN PATENT DOCUMENTS

| | | | | |
|---|---|---|---|---|
| EP | 1726778 | | 11/2006 | |
| JP | 2001-116371 | A | 4/2001 | |
| JP | 2005-106046 | A | 4/2005 | |
| JP | 2006-097636 | A | 4/2006 | |
| JP | 2006-118438 | A | 5/2006 | |
| JP | 2006-329140 | A | 12/2006 | |
| WO | WO 2005090875 | A1 * | 9/2005 | 60/513 |
| WO | WO 2006132053 | A1 * | 12/2006 | 418/11 |

* cited by examiner

*Primary Examiner* — Theresa Trieu

(74) *Attorney, Agent, or Firm* — Hamre, Schumann, Mueller & Larson, P.C.

(57) ABSTRACT

An expander-compressor unit (10) includes a two-stage rotary expansion mechanism (3) having a first cylinder (41) and a second cylinder (42). In the expansion mechanism (3), a suction port (71) facing a working chamber on the upstream side in the first cylinder (41) and a discharge port facing a working chamber on the downstream side in the second cylinder (42) are formed. An intermediate plate (43) is provided between the first cylinder (41) and the second cylinder (42). In the intermediate plate (43), a communication passage (43*a*) for allowing communication between a working chamber on the downstream side in the first cylinder (41) and a working chamber on the upstream side in the second cylinder (42) is formed. The communication passage (43*a*) does not communicate with the working chamber in the first cylinder (41) during the suction process, and communicates with the downstream working chamber in the first cylinder (41) at or after the end of the suction process.

11 Claims, 13 Drawing Sheets

TWO-STAGE ROTARY EXPANDER, EXPANDER-COMPRESSOR UNIT, AND REFRIGERATION CYCLE APPARATUS

TECHNICAL FIELD

The present invention relates to a two-stage rotary expander, an expander-compressor unit having a two-stage rotary expansion mechanism, and a refrigeration cycle apparatus.

BACKGROUND ART

A mechanical power recovery type refrigeration cycle apparatus has been known conventionally in which an expander recovers the energy of expanding working fluid and the recovered energy is used as a part of the power for driving a compressor (see, for example, JP 2001-116371 A).

As one type of expander, a rotary expander has been known. The rotary expander includes a cylinder and a piston that performs an eccentric rotational motion in the cylinder, and a working chamber that changes its internal volumetric capacity according to the eccentric rotational motion of the piston is formed between the cylinder and the piston. In the rotary expander, the following processes are carried out in sequence by the eccentric rotational motion of the piston: a suction process in which a working fluid is drawn into the working chamber through a suction port; an expansion process in which the working fluid expands in the working chamber; and a discharge process in which the working fluid is discharged through a discharge port. In the suction process, the volumetric capacity of the working chamber increases while the suction port is in communication with the working chamber. In the expansion process, the volumetric capacity of the working chamber increases while the suction port and discharge port are not in communication with the working chamber. In the discharge process, the volumetric capacity of the working chamber decreases while the working chamber is in communication with the discharge port.

In the case of what is called a single-stage rotary expander having only one cylinder, the suction process, expansion process and discharge process must be completed during one rotation of the piston in the cylinder. During the processes, the rate of the working fluid flowing into the working chamber increases gradually according to the rotation of the piston in the cylinder after the suction port opens, and then decreases and becomes zero at the end of the suction process. Accordingly, rapid fluctuation of pressure of the working fluid, which is called "pulsation", occurs in the suction port.

In view of this, a two-stage rotary expander having two cylinder-piston pairs has been proposed (see, for example, JP 2005-106046 A). The two-stage rotary expander disclosed in JP 2005-106046 A includes a first cylinder and a second cylinder. A working chamber on the downstream side in the first cylinder and a working chamber on the upstream side in the second cylinder are connected to each other via a communication passage. The suction process, expansion process and discharge process of the working fluid are carried out in the first cylinder, communication passage and second cylinder in an integrated manner. According to the description of JP 2005-106046 A, in this two-stage rotary expander, the rate of the working fluid flowing into the working chamber increases gradually according to the rotation of the piston in the first cylinder after the suction port opens, and then decreases gradually to zero. Therefore, it has been conceived that a rapid change in the inflow rate of the working fluid is suppressed and thus the pulsation of the working fluid can be suppressed.

The present inventors, however, have found, as a result of intensive studies, that even in this type of two-stage rotary expander, pulsation of the working fluid still occurs in association with the drawing thereof.

DISCLOSURE OF INVENTION

The present invention has been made in view of the above circumstances, and it is an object of the present invention to suppress further pulsation of a working fluid that occurs in association with the drawing thereof, in a two-stage rotary expander or an apparatus having a two-stage rotary expansion mechanism.

A two-stage rotary expander according to the present invention includes: a first cylinder; a first closing member for closing one end of the first cylinder; an intermediate closing member for closing the other end of the first cylinder; a second cylinder having one end closed by the intermediate closing member; a second closing member for closing the other end of the second cylinder; a first piston disposed in the first cylinder to form a first working chamber in the first cylinder together with the first closing member and the intermediate closing member, and configured to perform an eccentric rotational motion in the first cylinder; a second piston disposed in the second cylinder to form a second working chamber in the second cylinder together with the intermediate closing member and the second closing member, and configured to perform an eccentric rotational motion in the second cylinder; a first partition member for partitioning the first working chamber into an upstream first working chamber and a downstream first working chamber; a second partition member for partitioning the second working chamber into an upstream second working chamber and a downstream second working chamber; a suction port facing the upstream first working chamber; a communication passage formed in the intermediate closing member and having one end facing the downstream first working chamber and the other end facing the upstream second working chamber; and a discharge port facing the downstream second working chamber. This two-stage rotary expander has a structure in which the one end of the communication passage is kept from being connected to the suction port.

Preferably, the one end of the communication passage is provided at a position located inwardly away from an inner circumferential surface of the first cylinder and is opened or closed by the first piston so as to allow the one end of the communication passage to communicate only with the downstream first working chamber when not in communication with the suction port.

The one end of the communication passage may be approximately elliptical in shape extending in a direction along the inner circumferential surface of the first cylinder.

The suction port may be formed in the first cylinder.

The suction port may be formed in the first closing member or the intermediate closing member.

The suction port may be formed to extend over the first cylinder and the first closing member, or may be formed to extend over the first cylinder and the intermediate closing member.

An expander-compressor unit according to the present invention includes: an expansion mechanism constituting the two-stage rotary expander; a compression mechanism for compressing a working fluid; a rotating shaft for coupling the expansion mechanism and the compression mechanism; and a closed casing for accommodating the expansion mechanism, the compression mechanism, and the rotating shaft.

The rotating shaft may include: a first rotating shaft attached to the compression mechanism; and a second rotating shaft coupled to the first rotating shaft and attached to the expansion mechanism.

A refrigeration cycle apparatus according to the present invention includes the rotary expander.

A refrigeration cycle apparatus according to the present invention includes the expander-compressor unit.

The refrigeration cycle apparatus may be filled with carbon dioxide as a working fluid.

The present invention makes it possible to suppress pulsation of a working fluid that occurs in association with the drawing thereof in a two-stage rotary expander or an apparatus or the like having a two-stage rotary expansion mechanism.

Figure 1:
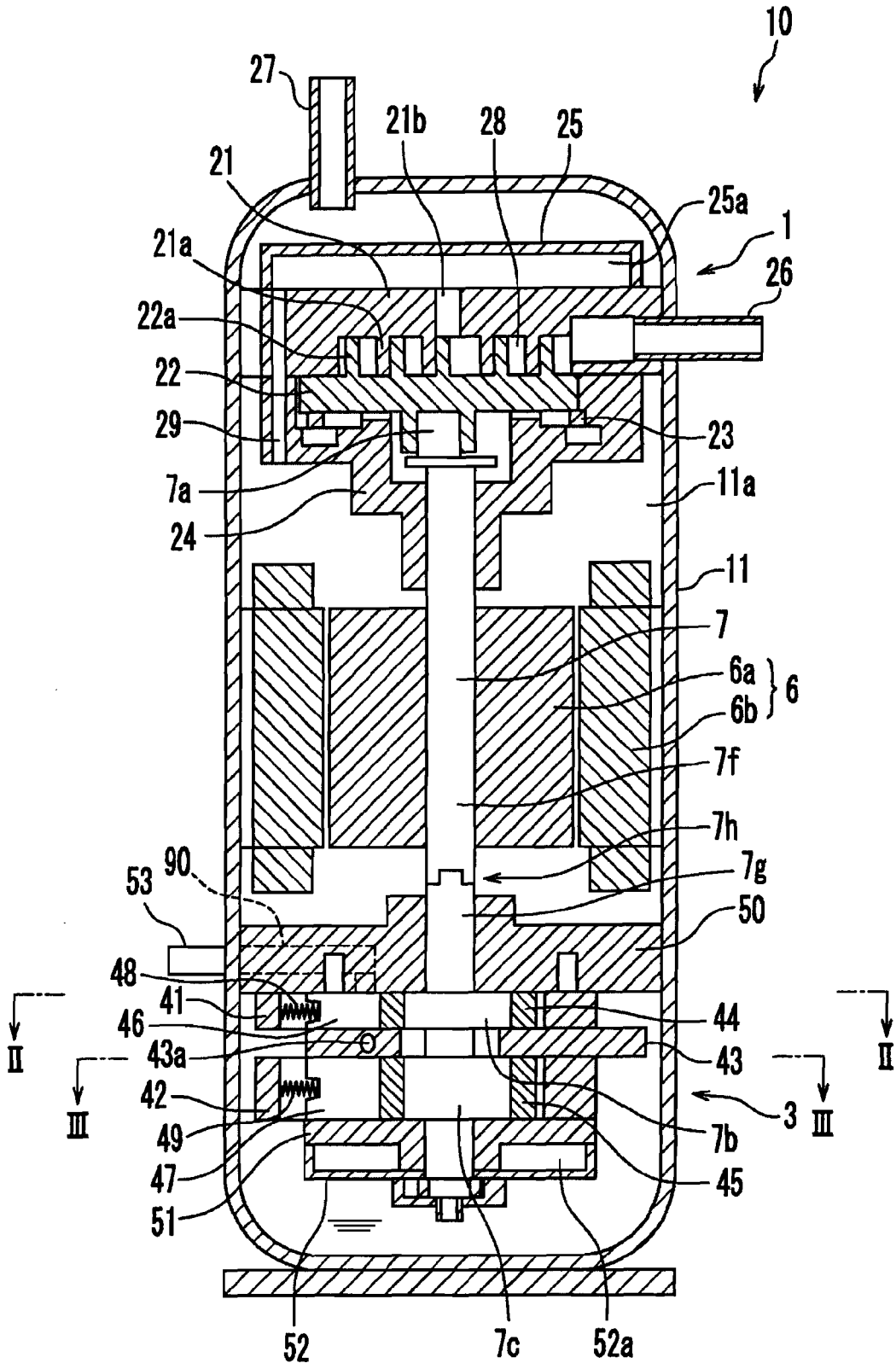
FIG. 1 is a vertical cross-sectional view of an expander-compressor unit according to an embodiment.

BEST MODE FOR CARRYING OUT THE INVENTION (Outline of Each Embodiment)

As a result of intensive studies, the present inventors have found that pulsation of a working fluid occurs in association with the drawing thereof in a two-stage rotary expander mainly for the following reasons. The two-stage rotary expander is provided with a communication passage for allowing communication between a working chamber on the downstream side in the first cylinder and a working chamber on the upstream side in the second cylinder, and this communication passage also constitutes a part of the working chamber. Since the communication passage is opened or closed by the piston almost instantaneously, when the communication passage is opened instantaneously, the volumetric capacity of the working chamber increases in a stepwise manner. The pressure in the communication passage is reduced in the expansion process that has been carried out until just before it is opened. Accordingly, when the communication passage is opened instantaneously during the suction process for drawing the working fluid, the working fluid flows rapidly into the working chamber through the suction port. As a result, the pressure of the working fluid in the expander changes rapidly, which causes pulsation.

In the respective embodiments to be described below, the communication passage is closed during the suction process and is opened at or after the end of the suction process. Hereinafter, the embodiments of the present invention will be described in detail. In the following respective embodiments, a working fluid is referred to as a refrigerant.

First Embodiment (Configuration of Expander-Compressor Unit)

As shown in FIG. 1, an expander-compressor unit 10 according to the present embodiment includes a closed casing 11, a scroll compression mechanism 1 disposed in the upper part of the closed casing 11, and a two-stage rotary expansion mechanism 3 disposed in the lower part of the closed casing 11. A rotation motor 6 with a rotor 6*a* and a stator 6*b* is disposed between the compression mechanism 1 and the expansion mechanism 3. The compression mechanism 1, the rotor 6*a* of the rotation motor 6, and the expansion mechanism 3 are coupled to each other by a rotating shaft 7.

(Configuration of Compression Mechanism)

The compression mechanism 1 includes a stationary scroll 21, an orbiting scroll 22, an Oldham ring 23, a bearing member 24, and a muffler 25. A suction pipe 26 and a discharge pipe 27 are connected to the closed casing 11. The orbiting scroll 22 is fitted to an eccentric pivot 7*a* of the rotating shaft 7, and its self-rotation is restrained by the Oldham ring 23. The orbiting scroll 22 is provided with a scroll lap 22*a*, and the stationary scroll 21 also is provided with a scroll lap 21*a*.

These laps 22*a* and 21*a* are meshed with each other to form a working chamber 28 having a crescent-shaped horizontal cross section.

The orbiting scroll 22, with its lap 22*a* meshing with the lap 21*a* of the stationary scroll 21, performs an orbiting motion as the rotating shaft 7 rotates. As a result, the crescent-shaped working chamber 28 formed between the laps 21*a*, 22*a* reduces its volumetric capacity as it moves radially from outside to inside, and thereby, the refrigerant drawn through the suction pipe 26 is compressed. The compressed refrigerant passes through a discharge port 21*b* formed at the center portion of the stationary scroll 21, an internal space 25*a* of the muffler 25, and a flow passage 29 penetrating the stationary scroll 21 and the bearing member 24, in this order. The working fluid then is discharged to an internal space 11*a* of the closed casing 11. While the refrigerant discharged in the internal space 11*a* remains there, lubricating oil mixed in the refrigerant is separated therefrom by gravitational force and centrifugal force. Then, the refrigerant is discharged from the discharge pipe 27.

(Configuration of Expansion Mechanism)

The expansion mechanism 3 includes a first cylinder 41, a second cylinder 42 with a greater thickness than the first cylinder 41, and an intermediate plate (intermediate closing member) 43 that serves as a partition between the cylinder 41 and the cylinder 42. The first cylinder 41 and the second cylinder 42 each are formed in a cylindrical shape having an inner circumferential surface forming a circular cylindrical surface. These cylinders 41, 42 are arranged vertically so that the center of the inner circumferential surface of one cylinder is aligned with that of the other cylinder.

The expansion mechanism 3 further includes a cylindrical first piston 44, a first vane (first partition member) 46, and a first spring 48 for biasing the first vane 46 toward the first piston 44. An eccentric portion 7*b* of the rotating shaft 7 is inserted into the first piston 44, and the first piston 44 performs an eccentric rotational motion in the first cylinder 41 as the eccentric portion 7*b* rotates. A radially extending vane groove 41*a* (see FIG. 2) is formed in the first cylinder 41. The first vane 46 is held reciprocably in the vane groove 41*a*. One end portion of the first vane 46 is in contact with the first piston 44, and the other end portion thereof is in contact with the first spring 48.

The expansion mechanism 3 also includes a cylindrical second piston 45, a second vane (second partition member) 47, and a second spring 49 for biasing the second vane 47 toward the second piston 45. An eccentric portion 7*c* of the rotating shaft 7 is inserted into the second piston 45, and the second piston 45 performs an eccentric rotational motion in the second cylinder 42 as the eccentric portion 7*c* rotates. A radially extending vane groove 42*a* (see FIG. 3) is formed in the second cylinder 42. The second vane 47 is held reciprocably in the vane groove 42*a*. One end portion of the second vane 47 is in contact with the second piston 45, and the other end portion thereof is in contact with the second spring 49.

The expansion mechanism 3 further includes an upper end plate (first closing member) 50 and a lower end plate (second closing member) 51 that are disposed so as to sandwich the first cylinder 41, the intermediate plate 43 and the second cylinder 42 therebetween. The upper end plate 50 and the intermediate plate 43 sandwich the first cylinder 41 therebetween from above and below, and the intermediate plate 43 and the lower end plate 51 sandwich the second cylinder 42 therebetween from above and below. Specifically, the upper end plate 50 closes the upper end (one end) of the first cylinder 41, the intermediate plate 43 closes the lower end (the other end) of the first cylinder 41 and the upper end (one end) of the second cylinder 42, and the lower end plate 51 closes the lower end (the other end) of the second cylinder. Thereby, the upper end plate 50, the intermediate plate 43, and the first piston 41 disposed in the first cylinder 41 form a first working chamber in the first cylinder 41, and the intermediate plate 43, the lower end plate 51, and the second piston disposed in the second cylinder 42 form a second working chamber in the second cylinder 42. The upper end plate 50 and the lower end plate 51, together with the bearing member 24 of the compression mechanism 1, also serve as a bearing member for supporting the rotating shaft 7 rotatably. As with the compression mechanism 1, the expansion mechanism 3 also includes a muffler 52. A suction pipe 53 and a discharge pipe 58 (not shown in FIG. 1, see FIG. 2) are connected to the expansion mechanism 3.

Figure 2:
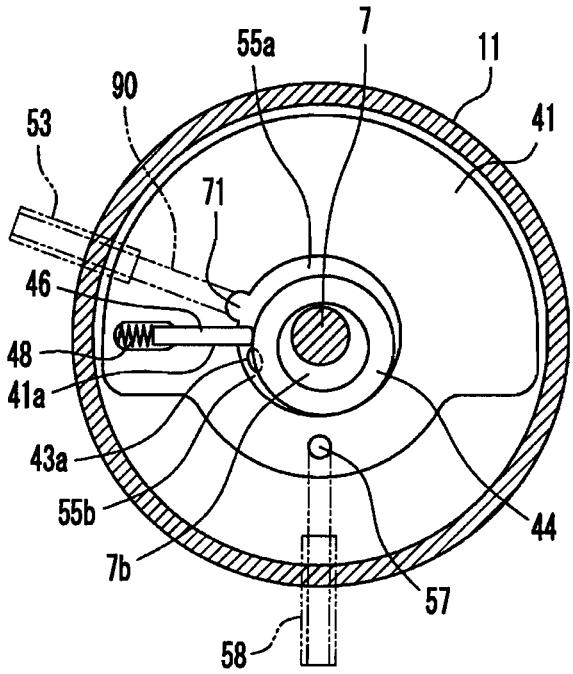
FIG. 2 is a cross-sectional view of FIG. 1 taken along a line II-II.
Figure 3:
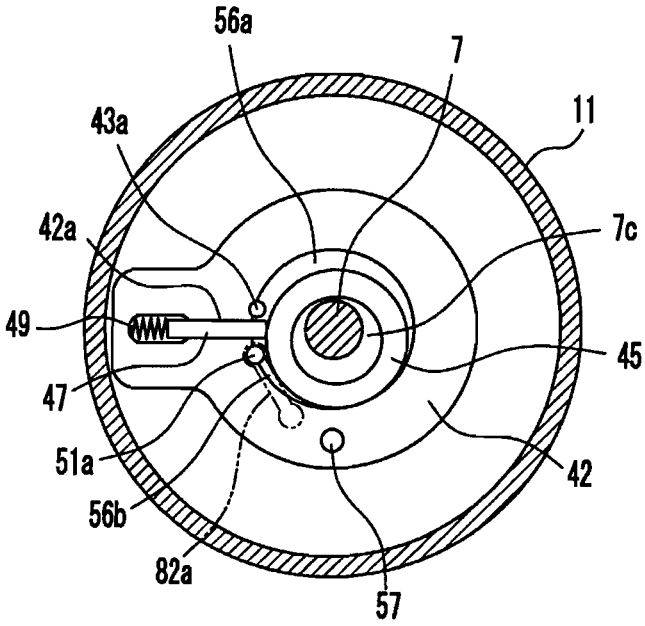
FIG. 3 is a cross-sectional view of FIG. 1 taken along a line III-III.

As shown in FIG. 2, an upstream first working chamber 55*a* and a downstream first working chamber 55*b* are formed in a space inside the first cylinder 41 and outside the first piston 44. These working chambers 55*a*, 55*b* are formed by partitioning the above-mentioned first working chamber with the first vane 46. As shown in FIG. 3, an upstream second working chamber 56*a* and a downstream second working chamber 56*b* are formed in a space inside the second cylinder 42 and outside the second piston 45. These working chambers 56*a*, 56*b* are formed by partitioning the above-mentioned second working chamber with the second vane 47. Since the second cylinder 42 has a greater thickness (vertical length) than the first cylinder 41, the total volumetric capacity of the two working chambers 56*a*, 56*b* in the second cylinder 42 is greater than that of the two working chambers 55*a*, 55*b* in the first cylinder 41.

As shown in FIG. 1, a suction passage 90 extending radially inwardly and then curving downwardly is formed in the upper end plate 50. The suction pipe 53 is connected to the radially outward end of the suction passage 90. As shown in FIG. 2, a suction port 71 in the form of a vertical groove that is recessed radially outwardly is formed on the inner circumferential surface of the first cylinder 41. The suction port 71 opens radially inwardly toward the upstream first working chamber 55*a* in the first cylinder 41, and faces the upstream first working chamber 55*a*. The suction port 71 is located at the downstream end of the suction passage 90 and connected to the suction passage 90. Thereby, the refrigerant drawn from the suction pipe 53 flows through the suction passage 90 and then is supplied to the working chamber 55*a* through the suction port 71.

As shown in FIG. 1, the communication passage 43*a* is formed in the intermediate plate 43. One end (upstream opening) of the communication passage 43*a* faces the downstream first working chamber 55*b* in the first cylinder 41 (see FIG. 2), and the other end (downstream opening) of the communication passage 43*a* faces the upstream second working chamber 56*a* in the second cylinder 42 (see FIG. 3). Thereby, the downstream first working chamber 55*b* in the first cylinder 41 and the upstream second working chamber 56*a* in the second cylinder 42 communicate with each other through the communication passage 43*a*. These downstream first working chamber 55*b*, the communication passage 43*a*, and the upstream second working chamber 56*a* serve as one working chamber. Hereinafter, the working chamber formed by the downstream first working chamber 55*b*, the communication passage 43*a*, and the upstream second working chamber 56*a* is referred to as an expansion chamber.

The expansion mechanism 3 of the present embodiment has a structure in which one end of the communication passage 43*a* is kept from being connected to the suction port 71. Although the details of the structure are described later, one end of the communication passage 43*a* is provided at a position located inwardly away from the inner circumferential surface of the first cylinder 41, and is opened or closed by the first piston 44 so as to allow the one end of the communication passage 43*a* to communicate only with the downstream first working chamber 55*b* when not in communication with the suction port 71. In the present embodiment, the suction process, expansion process and discharge process of the refrigerant are carried out in the working chambers 55*a*, 55*b* in the first cylinder 41, the communication passage 43*a*, and the working chambers 56*a*, 56*b* in the second cylinder 42 in an integrated manner, but the suction process is not carried out in the communication passage 43*a*, in which a part of the expansion process is carried out.

As shown in FIG. 3, the discharge port 51*a* opening upwardly toward the downstream second working chamber 56*b* and facing the downstream second working chamber 56*b* is formed in the lower end plate 51. The downstream second working chamber 56*b* in the second cylinder 42 communicates with the internal space 52*a* (see FIG. 1) of the muffler 52 through the discharge port 51*a*. In the first cylinder 41 and the second cylinder 42, a flow passage 57 penetrating these first cylinder 41 and the second cylinder 42 is formed. The downstream end of the flow passage 57 is connected to the discharge pipe 58. With such a configuration, the refrigerant that has expanded in the downstream second working chamber 56*b* is first discharged to the internal space 52*a* through the discharge port 51*a*, passes through the flow passage 57, and then is discharged through the discharge pipe 58.

As shown in FIG. 3, the discharge port 51*a* formed in the lower end plate 51 is provided with a discharge valve 82*a*. The discharge valve 82*a* is made of, for example, a metal thin plate, and is disposed so as to close the discharge port 51 from the side of the internal space 52*a* of the muffler 52. The discharge valve 82*a* is a differential pressure valve that opens when the pressure on the upstream side (on the side of the downstream second working chamber 56*b* in the second cylinder 42) becomes higher than that of the downstream side (on the side of the internal space 52*a* of the muffler 52). The discharge valve 82*a* has a function of preventing over-expansion of the refrigerant in the expansion mechanism 3. The discharge valve 82*a* is not necessarily required, and it may be omitted.

As shown in FIG. 1, in the present embodiment, the rotating shaft 7 includes a rotating shaft 7*f* on the side of the compression mechanism 1 and a rotating shaft 7*g* on the side of the expansion mechanism 3. These rotating shaft 7*f* and rotating shaft 7*g* are coupled at a coupling portion 7*h*. The structure of the coupling portion 7*h* is not limited in any way, and for example, a spline, serration, or the like can be used suitably.

(Configuration of Refrigeration Cycle Apparatus)

Figure 4:
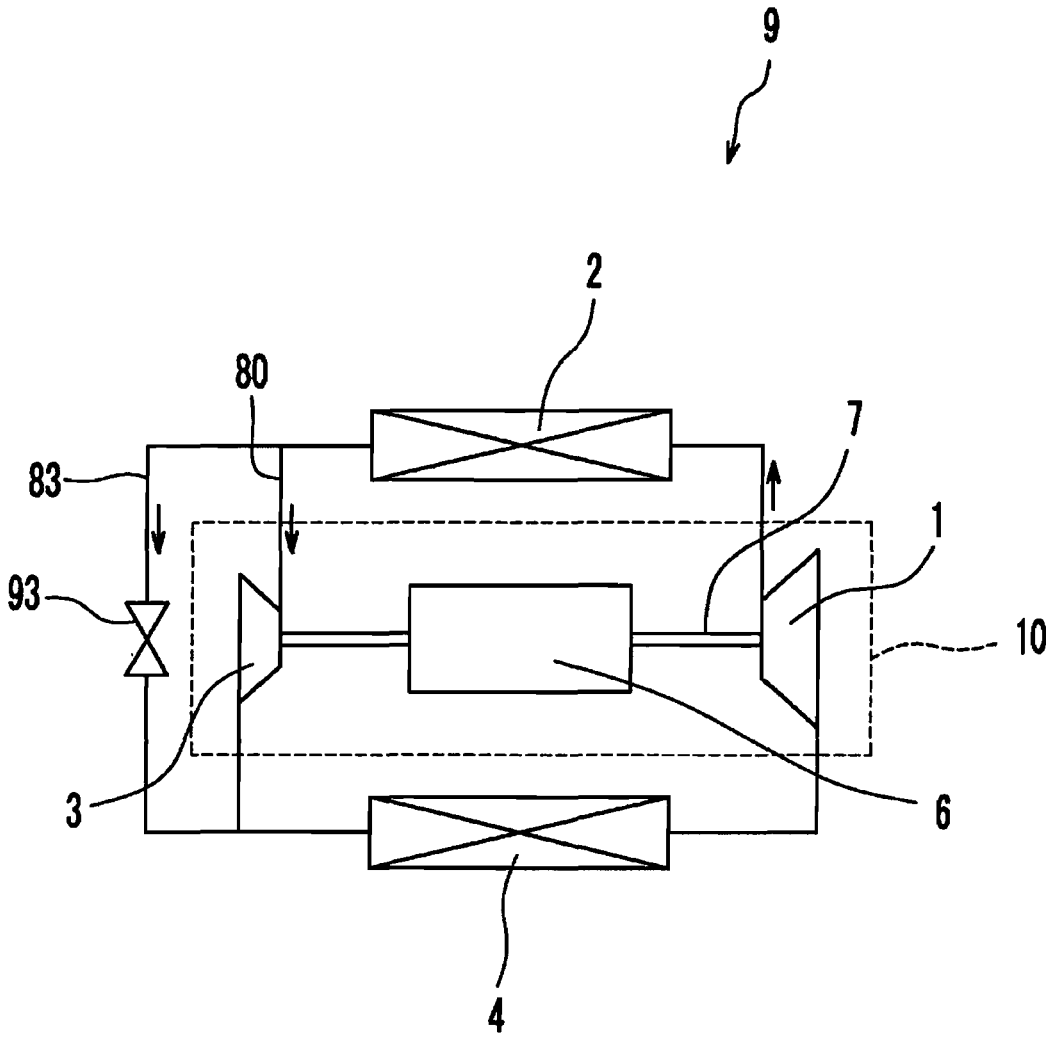
FIG. 4 is a refrigerant circuit diagram of a refrigeration cycle apparatus according to a first embodiment.
Figure 5A:
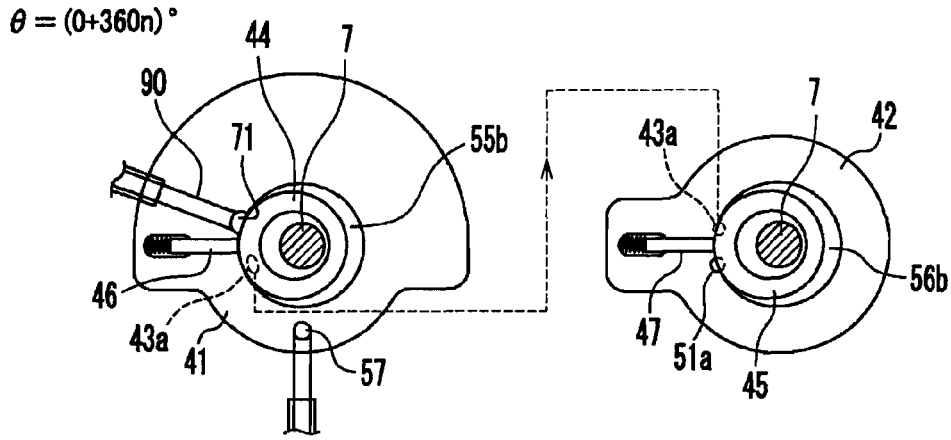
FIG. 5A is a diagram illustrating an operating principle of an expansion mechanism of an expander-compressor unit.
Figure 5B:
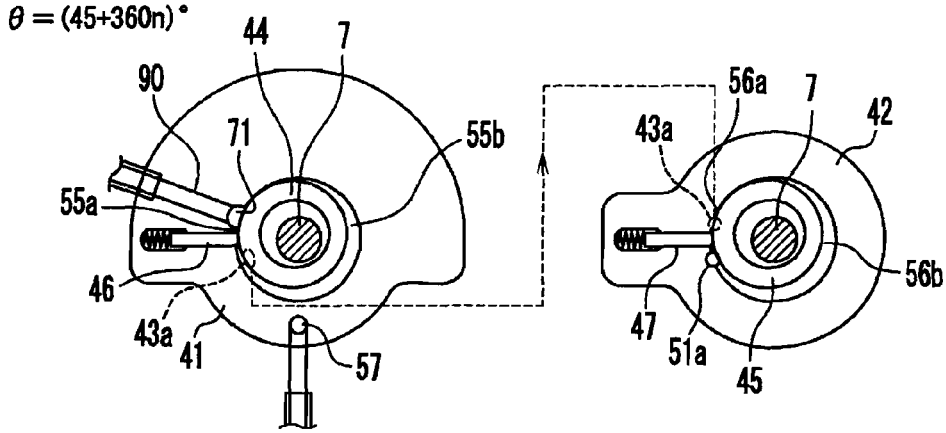
FIG. 5B is a diagram illustrating an operating principle of an expansion mechanism of an expander-compressor unit.
Figure 5C:
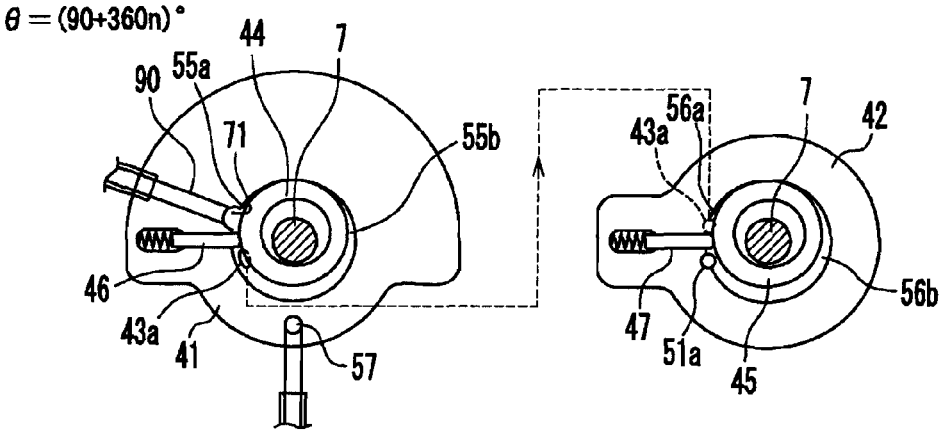
FIG. 5C is a diagram illustrating an operating principle of an expansion mechanism of an expander-compressor unit.
Figure 6A:
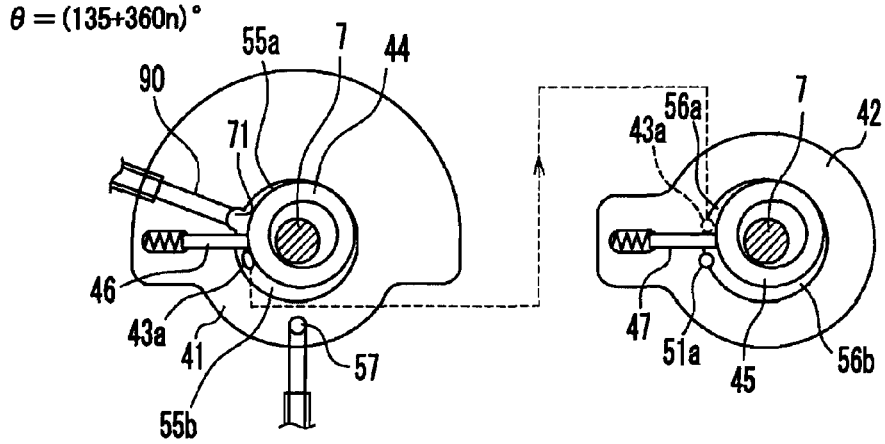
FIG. 6A is a diagram illustrating an operating principle of an expansion mechanism of an expander-compressor unit.
Figure 6B:
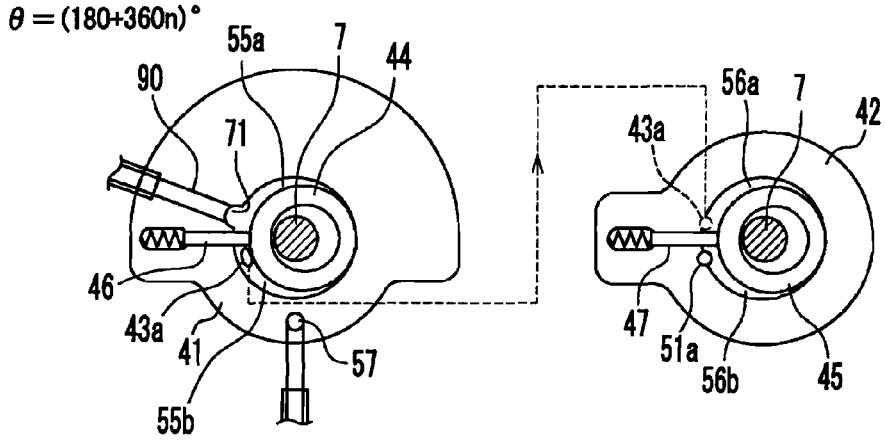
FIG. 6B is a diagram illustrating an operating principle of an expansion mechanism of an expander-compressor unit.
Figure 6C:
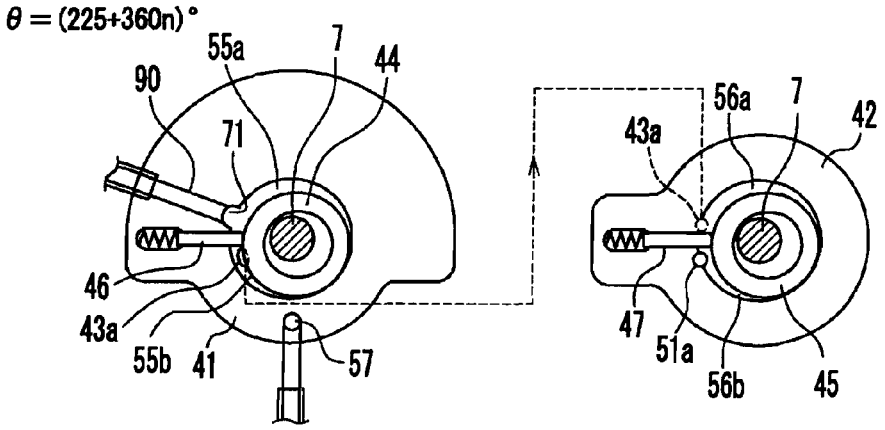
FIG. 6C is a diagram illustrating an operating principle of an expansion mechanism of an expander-compressor unit.
Figure 7A:
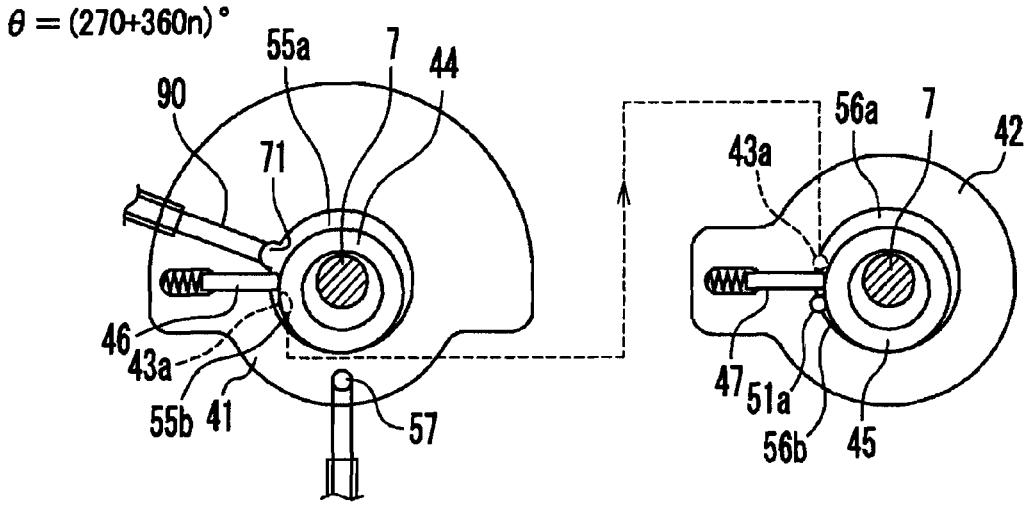
FIG. 7A is a diagram illustrating an operating principle of an expansion mechanism of an expander-compressor unit.
Figure 7B:
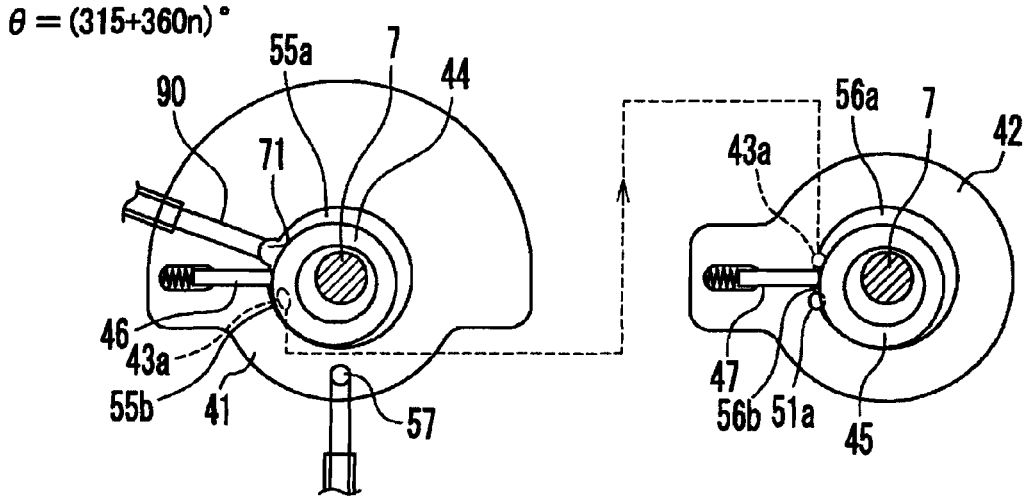
FIG. 7B is a diagram illustrating an operating principle of an expansion mechanism of an expander-compressor unit.

As shown in FIG. 4, a refrigeration cycle apparatus 9 according to the present embodiment includes a radiator (gas cooler) 2 and an evaporator 4 as well as the expander-compressor unit 10. The refrigeration cycle apparatus 9 includes a main refrigerant circuit 80 having the compression mechanism 1 of the expander-compressor unit 10, the radiator 2, the expansion mechanism 3 of the expander-compressor unit 10, and the evaporator 4, which are connected in a circuit in this order. The refrigeration cycle apparatus 9 also includes a bypass passage 83. The bypass passage 83 is a passage for supplying the refrigerant from the radiator 2 directly to the evaporator 4 and not through the expansion mechanism 3. The bypass passage 83 is provided with an openable and closable valve 93. As the valve 93, an opening adjustable solenoid valve or the like can be used suitably.

The refrigerant cycle apparatus 9 is filled with carbon dioxide as a refrigerant. In the present embodiment, the refrigerant is in a supercritical state on the high-pressure side of the refrigerant circuit (specifically, in a path from the compression mechanism 1 to the expansion mechanism 3 through the radiator 2). The type of the refrigerant is not particularly limited.

(Operation of Expansion Mechanism)

Next, the operation of the expansion mechanism 3 of the expander-compressor unit 10 will be described with reference to FIG. 5A to FIG. 7B. FIG. 5A to FIG. 7B show the states of the pistons 44, 45 that change as the rotational angle θ of the rotating shaft 7 advances by 45 degrees. It is assumed here that a position at which the contact point between the first cylinder 41 and the first piston 44 is in contact with the first vane 46 is what is called a top dead center (θ=0°), and that a clockwise direction, which is the rotational direction of the rotating shaft 7, is indicated as a positive direction of the rotational angle θ. The expansion mechanism 3 performs one cycle from the suction process to the discharge process during three rotations of the rotating shaft 7. Therefore, in FIG. 5A to FIG. 7B, the rotational angle θ is represented by an integer n (n=0, 1, and 2).

Figure 8A:
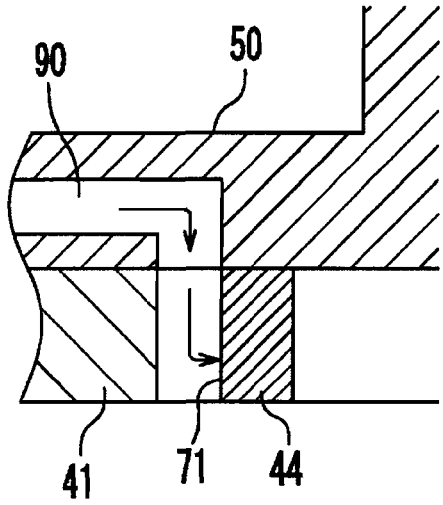
FIG. 8A is a vertical cross-sectional view of a part of an expansion mechanism according to a first embodiment.
Figure 8B:
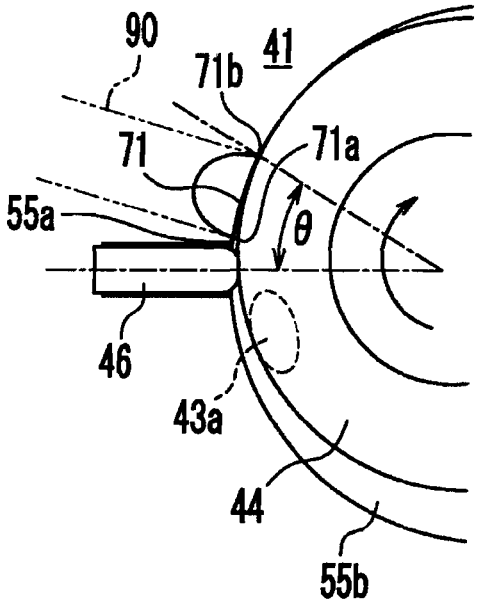
FIG. 8B is a horizontal cross-sectional view of a part of the expansion mechanism according to the first embodiment.

First, the cycle of the expansion mechanism 3 starts at θ=0° of the first rotation of the pistons 44, 45. As soon as the contact point between the first cylinder 41 and the first piston 44 passes one end 71*a* of the suction port 71 in the circumferential direction (see FIG. 8B) at θ=10° (not shown), the upstream first working chamber 55*a* communicates with the suction port 71 and the suction process starts. As shown in FIG. 8B, the pistons 44, 45 rotate further, and at θ=30°, the contact point between the first cylinder 41 and the first piston 44 passes the other end 71*b* of the suction port 71 in the circumferential direction. Thus, the suction port 71 is opened fully.

Since the suction port 71 has a circumferential length as mentioned above, it is opened gradually as the piston 44 rotates. However, since the piston 44 rotates at high speed, the suction port 71 is opened instantaneously, in fact. For ease of explanation, hereinafter, it is assumed that the suction port 71 changes its state from a closed state to an open state instantaneously when the contact point between the first cylinder 41 and the first piston 44 passes the center point of the suction port 71 in the circumferential direction (θ=20°), unless otherwise specified. The same applies to the communication passage 43*a* and the discharge port 51*a*.

After the suction process starts, the rotational angle θ increases as the pistons 44, 45 rotate, and the volumetric capacity of the upstream first working chamber 55*a* increases as the rotational angle θ increases. Before long, when the contact point between the first cylinder 41 and the first piston 44 passes θ=360°, at which the second rotation (n=1) starts, the upstream first working chamber 55*a* shifts to the downstream first working chamber 55*b*.

The rotating shaft 7 rotates further, and at θ=380°, (θ=390°, to be accurate), the contact point between the first cylinder 41 and the first piston 44 passes the suction port 71. Thus, the communication between the downstream first working chamber 55*b* and the suction port 71 is cut off. At this point in time, the suction process is completed and the expansion process starts.

As described above, in the present embodiment, the suction port 71 is formed at a position of θ=20°, and the suction port 71 is displaced slightly from the first vane 46 in the rotational direction of the piston 44. Accordingly, the suction process continues until the suction port 71 is closed, even after the upstream first working chamber 55*a* shifts to the downstream first working chamber 55*b*. Specifically, in the case where the upstream working chamber 55*a* and the downstream working chamber 55*b* are defined as chambers partitioned by the first vane 46 as a partition member, there is a short period of time when the refrigerant is drawn into the downstream working chamber 55*b*. In the present specification, among the upstream working chamber 55*a* and the downstream working chamber 55*b*, a working chamber that is to communicate with the suction port 71 is referred to as a "suction side first working chamber", and a working chamber that is not to communicate with the suction port 71 is referred to as a "discharge side first working chamber". Assuming that the position of the first vane 46 coincides with the position of the suction port 71 in the rotational direction of the piston 44, the upstream first working chamber 55*a* corresponds to the suction side first working chamber, and the downstream first working chamber 55*b* corresponds to the discharge side first working chamber.

As described above, in the present embodiment, one end of the communication passage 43*a* is provided at a position located inwardly away from the inner circumferential surface of the first cylinder 41, and is opened or closed by the first piston 44 so as to allow the one end of the communication passage 43*a* to communicate only with the downstream first working chamber 55*b* when not in communication with the suction port 71. Specifically, the one end of the communication passage 43*a* is approximately elliptical in shape extending in a direction along the inner circumferential surface of the first cylinder 41. For example, the one end of the communication passage 43*a* is opened gradually after the rotational angle θ of the rotating shaft 7 exceeds 30° and opened fully when the rotational angle θ reaches 120°. For example, the one end of the communication passage 43*a* is closed gradually after the rotational angle θ of the rotating shaft 7 exceeds 210° and closed completely when the rotational angle θ reaches 330°. In other words, the one end of the communication passage 43*a* is covered during a period from when the contact point between the first cylinder 41 and the first piston 44 comes close to this one end until when it passes the suction port 71. Accordingly, the one end of the communication passage 43*a* communicates neither with the upstream first working chamber 55*a* nor with the downstream first working chamber 55*b* in communication with the suction port 71. As a result, the one end of the communication passage 43*a* is kept from being connected to the suction port 71.

An angle at which the one end of the communication passage 43*a* is opened or closed is not limited to the above-mentioned angle, as long as the one end of the communication passage 43*a* is formed at a position such that it does not communicate with the upstream first working chamber 55*a* or with the downstream first working chamber 55*b* in communication with the suction port 71 during the suction process, and that it communicates with the downstream first working chamber 55*b* at the end of the suction process at which the communication between the suction port 71 and the downstream first working chamber 55*b* is cut off, or after the end thereof.

When the communication passage 43*a* communicates with the downstream first working chamber 55*b* at or after the moment when the contact point between the first cylinder 41 and the first piston 44 passes the suction port 71, the downstream first working chamber 55*b* communicates with the upstream second working chamber 56*a* in the second cylinder 42 via the communication passage 43*a* to form one working chamber (i.e., expansion chamber).

As the rotating shaft 7 rotates further, the volumetric capacity of the downstream first working chamber 55*b* decreases. However, since the second cylinder 42 has a greater thickness (vertical length) than the first cylinder 41, the volumetric capacity of the upstream second working chamber 56*a* increases at a higher rate than the decreasing rate of the downstream first working chamber 55*b*. As a result, the volumetric capacity of the expansion chamber (i.e., the total volumetric capacity of the downstream first working chamber 55*b*, the communication passage 43*a* and the upstream second working chamber 56*a*) goes on increasing and the refrigerant expands accordingly.

When the rotating shaft 7 rotates further and the rotational angle θ reaches 700° (not shown), the contact point between the second cylinder 42 and the second piston 45 passes the discharge port 51*a*, and the expansion chamber (specifically, the working chamber 56*a*) communicates with the discharge port 51*a*. At this point in time, the expansion process is completed and the discharge process starts.

At θ=720° at which the third rotation (n=2) starts, the downstream first working chamber 55*b* in the first cylinder 41 disappears and the upstream second working chamber 56*a* in the second cylinder 42 shifts to the downstream second working chamber 56*b*. As the rotating shaft 7 rotates further, the volumetric capacity of the downstream second working chamber 56*b* decreases and the refrigerant is discharged from the discharge port 51*a*. Thereafter, the downstream second working chamber 56*b* disappears at θ=1080° and the discharge process is completed.

(Relationship Between Rotational Angle and Volumetric Capacity of Working Chamber)

Figure 9:
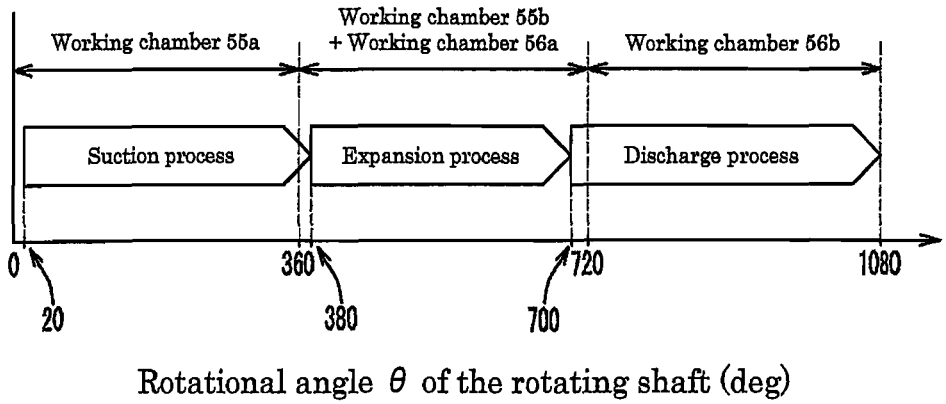
FIG. 9 is a diagram showing a relationship between a rotational angle of a rotating shaft and each process of a working chamber in an expansion mechanism of an expander-compressor unit.
Figure 10:
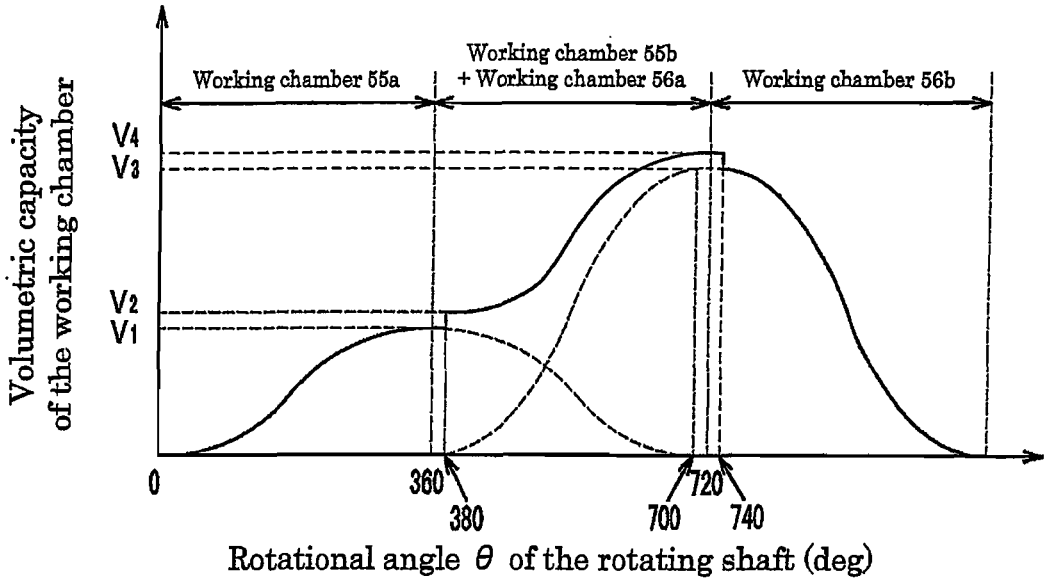
FIG. 10 is a diagram showing a relationship between a rotational angle of a rotating shaft and a volumetric capacity of a working chamber in an expansion mechanism of an expander-compressor unit.

FIG. 9 shows a relationship between the rotational angle θ of the rotating shaft 7 and each process. FIG. 10 shows a relationship between the rotational angle θ of the rotating shaft 7 and the volumetric capacity of the working chamber. As shown in FIG. 10, in the suction process, the volumetric capacity of the working chamber increases continuously in a sinusoidal waveform. On the other hand, when the suction process is completed, the downstream first working chamber 55*b* communicates with the communication passage 43*a*, which also becomes a part of the working chamber. Accordingly, the volumetric capacity of the working chamber increases in a stepwise manner ($V_1 \rightarrow V_2$) immediately after the end of the suction process. That is, the volumetric capacity of the working chamber increases discontinuously by the volumetric capacity ΔV of the communication passage 43*a*. Thereafter, the volumetric capacity of the working chamber increases continuously again as that of the working chamber 56*a* increases. Then, in the discharge process, when the communication between the communication passage 43*a* and the upstream second working chamber 56*a* is cut off (for example, θ=740°), the volumetric capacity of the working chamber decreases by the volumetric capacity ΔV of the communication passage 43*a* in a stepwise manner ($V_4 \rightarrow V_3$), and thereafter, it decreases in a sinusoidal waveform.

Advantageous Effects of Present Embodiment

As described above, according to the present invention, in the two-stage rotary expansion mechanism 3 having the first cylinder 41 and the second cylinder 42, the communication passage 43*a* for allowing communication between the downstream first working chamber 55*b* of the first cylinder 41 and the upstream second working chamber 56*a* of the second cylinder 42 does not communicate with the upstream first working chamber 55*a* or with the downstream first working chamber 55*b* in communication with the suction port 71 during the suction process, and communicates with the downstream first working chamber 55*b* at or after the end of the suction process. Therefore, it is possible to avoid the increase in volumetric capacity of the working chamber in a stepwise manner during the suction process. Accordingly, it is possible to prevent discontinuous behavior in the suction operation, and thus suppress a sudden change in the refrigerant flow. As a result, pulsation of the refrigerant that occurs in association with the drawing thereof can be suppressed.

Here, one end of the communication passage 43*a* may, for example, be circular in shape. If the one end of the communication passage 43*a* is approximately elliptical in shape extending in the direction along the inner circumferential surface of the first cylinder 41, as in the present embodiment, the closed space formed immediately after the communication passage 43*a* is closed completely by the first piston 44 can be reduced. Accordingly, it is possible to prevent unnecessary compression of the refrigerant in the closed space and a vane jumping phenomenon that may occur in association with this unnecessary compression.

In the expander-compressor unit 10 according to the present embodiment 10, the first rotating shaft 7*f* attached to the compression mechanism 1 and the second rotating shaft 7*g* attached to the expansion mechanism 3 are aligned and coupled to each other. Therefore, slight wobble may occur at the coupling portion 7*h* between the first rotating shaft 7*f* and the second rotating shaft 7*g*. Accordingly, if pulsation of the refrigerant occurs in association with the drawing thereof, torque fluctuation occurs at the second rotating shaft 7*g*, which may affect adversely the first rotating shaft 7*f* and eventually the compression mechanism 1. For example, when a small shock is applied to the coupling portion 7*h*, the operation of the rotating shaft 7 may become unstable. The present embodiment, however, makes it possible to suppress the pulsation of the refrigerant that occurs in association with the drawing thereof, and thus to stabilize the operation of the rotating shaft 7. As a result, it is possible to stabilize the operation of the expansion mechanism 3 and the compression mechanism 1, and thereby to improve their reliability.

In the case where the first rotating shaft 7*f* on the side of the compression mechanism 1 and the second rotating shaft 7*g* on the side of the expansion mechanism 3 constitute the rotating shaft 7, as in the present embodiment, the compression mechanism 1 and the expansion mechanism 3 can be assembled easily into the closed casing 11.

In the present embodiment, the suction port 71 is formed by a vertical groove in the inner circumferential surface of the first cylinder 41. That is, the suction port 71 is formed in the first cylinder 41. Therefore, the suction port 71 can have a large opening area. Specifically, in the case where the suction port 71 is formed in the first cylinder 41, the vertical length of the suction port 71 can be extended to a length that is almost equal to the vertical length of the first cylinder 41. Therefore, the suction port 71 can have a larger opening area. As a result, the pressure loss of the refrigerant can be reduced during the process of drawing it.

In the present embodiment, carbon dioxide is used as the refrigerant. When carbon dioxide is used as the refrigerant, the difference between the high-pressure-side pressure and the low-pressure-side pressure in the refrigeration cycle is large. Therefore, the mechanical power recovery effect in the expansion mechanism 3 becomes more significant. Furthermore, when the difference between the high-pressure-side pressure and the low-pressure-side pressure is large, the pulsation of the refrigerant that occurs in association with the drawing thereof has a more serious impact. Accordingly, the pulsation suppression effect of the present embodiment is exhibited more significantly.

Second Embodiment

In the second embodiment, the suction port 71 of the expansion mechanism 3 of the first embodiment is modified. Since the components of the second embodiment are the same as those of the first embodiment except the suction port 71, the description thereof is not repeated.

Figure 11A:
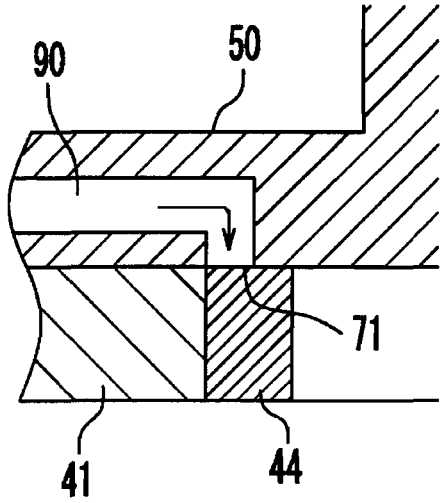
FIG. 11A is a vertical cross-sectional view of a part of an expansion mechanism according to a second embodiment.
Figure 11B:
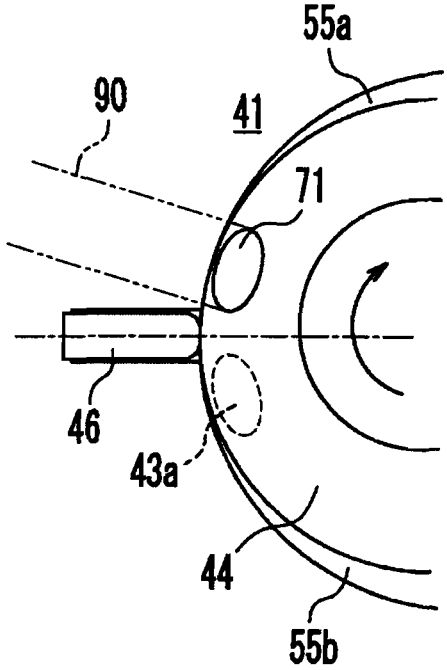
FIG. 11B is a horizontal cross-sectional view of a part of the expansion mechanism according to the second embodiment.

As shown in FIG. 11A and FIG. 11B, in the second embodiment, the suction port 71 of the expansion mechanism 3 is formed in the upper end plate 50. Specifically, in the second embodiment, the downstream end of the suction passage 90 formed in the upper end plate 50 faces the working chamber in the first cylinder 41, and this downstream end of the suction passage 90 (lower end thereof in FIG. 11A) serves as the suction port 71. The suction port 71 opens downwardly toward the working chamber in the first cylinder 41.

Also in the present embodiment, the communication passage 43*a* is formed so that it does not communicate with the upstream first working chamber 55*a* or the downstream first working chamber 55*b* that is in communication with the suction port 71 during the suction process, and it communicates with the downstream first working chamber 55*b* at or after the end of the suction process. Thereby, almost the same advantageous effects can be obtained as in the first embodiment.

Figure 13A:
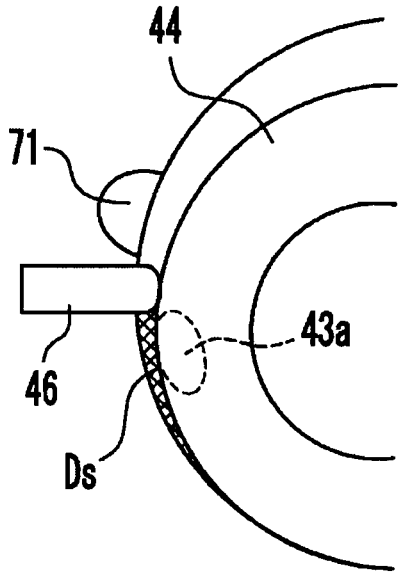
FIG. 13A is a diagram illustrating a closed space in a working chamber.

When the suction port 71 is formed in the first cylinder 41 as shown in FIG. 13A, a rotational angle θ at which the suction port 71 is blocked increases, and thus one end of the communication passage 43*a* needs to be formed at a position located more radially inwardly, by the increased angle, away from the inner circumferential surface of the first cylinder 41. As a result, when the one end of the communication passage 43*a* is closed, a space that remains in the downstream first working chamber 55*b*, that is, a closed space Ds, has a larger volume. This closed space Ds is what is called a dead volume, which may cause a decrease in the efficiency of the expansion mechanism 3. In contrast, in the present embodiment, since the suction port 71 is formed in the upper end plate 50, the one end of the communication passage 43*a* can be closed when the rotating shaft 7 is located at or in the vicinity of the rotational angle θ of 360° (top dead center) (see FIG. 11B). Furthermore, the suction port 71 can be opened at or in the vicinity of the top dead center. Thereby, the closed space can be reduced or eliminated. As a result, the efficiency of the expansion mechanism 3 can be improved. Furthermore, the refrigerant can be drawn more smoothly, and the torque fluctuation of the rotating shaft 7 can be suppressed.

In the present embodiment, if the suction port 71 is located further radially inwardly than the position indicated in FIG. 11B, it is possible to keep the one end of the communication passage 43*a* from being connected to the suction port 71, even if the one end thereof is provided at a position in contact with the inner circumferential surface of the first cylinder 41.

Third Embodiment

Also in the third embodiment, the suction port 71 of the expansion mechanism 3 of the first embodiment is modified. Since the components of the third embodiment are the same as those of the first embodiment except the suction port 71, the description thereof is not repeated.

Figure 12A:
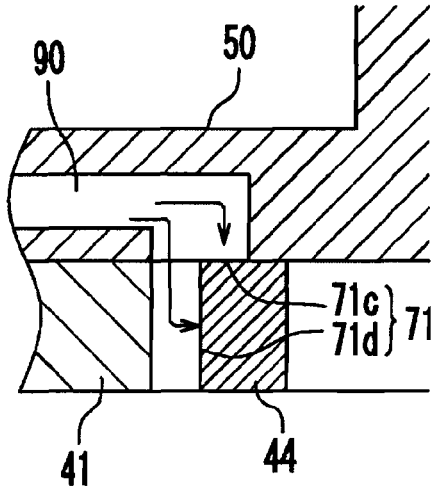
FIG. 12A is a vertical cross-sectional view of a part of an expansion mechanism according to a third embodiment.
Figure 12B:
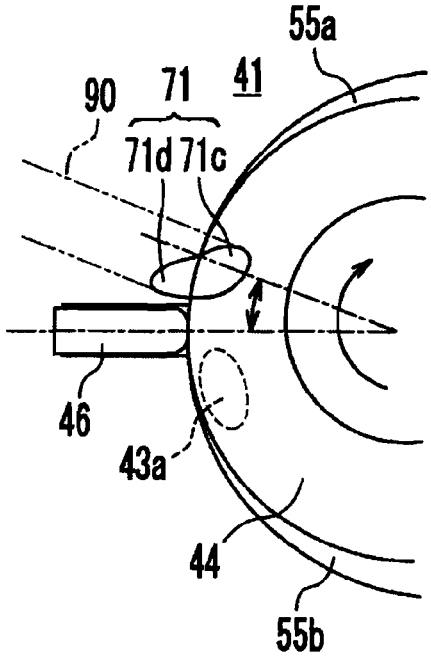
FIG. 12B is a horizontal cross-sectional view of a part of the expansion mechanism according to the third embodiment.

As shown in FIG. 12A and FIG. 12B, in the third embodiment, the suction port 71 of the expansion mechanism 3 is formed to extend over the first cylinder 41 and the upper end plate 50. Specifically, in the third embodiment, the suction port 71 is formed by a port 71*d* that is a vertical groove formed in the inner circumferential surface of the first cylinder 41 and a port 71*c* formed in the upper end plate 50. The port 71*d* opens radially inwardly toward the working chamber in the first cylinder 41, and the port 71*c* opens downwardly toward the working chamber in the first cylinder 41.

Also in the present embodiment, the communication passage 43*a* is formed so that it does not communicate with the working chamber 55*a* or 55*b* during the suction process and it communicates with the working chamber 55*b* at or after the end of the suction process. Thereby, almost the same advantageous effects can be obtained as in the first embodiment.

Figure 13B:
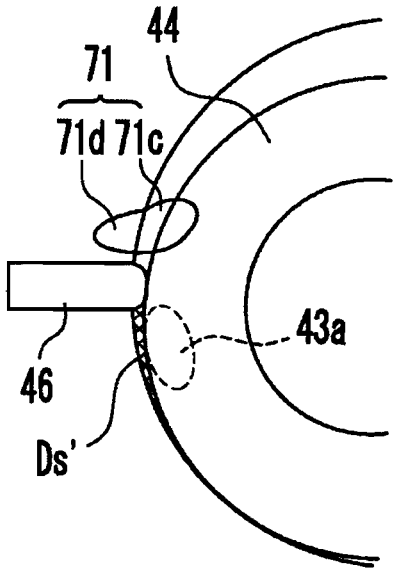
FIG. 13B is a diagram illustrating a closed space in a working chamber.

Furthermore, in the present embodiment, a part of the suction port 71 is formed in the first cylinder 41, and the other part thereof is formed in the upper end plate 50. Therefore, the suction port 71 can have a larger opening area, and the volume of a closed space Ds' (see FIG. 13B) can be reduced. As a result, it is possible to achieve both the reduction of the pressure loss of the drawn refrigerant and improvement of the efficiency of the expansion mechanism 3.

(Other Modifications)

Figure 14:
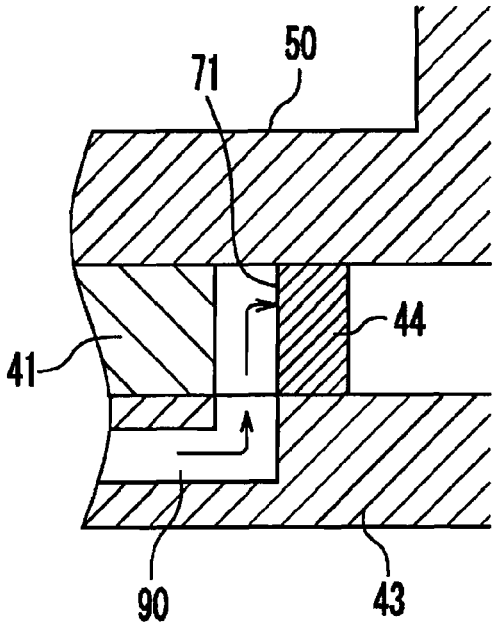
FIG. 14 is a vertical cross-sectional view of a part of an expansion mechanism according to a modification.
Figure 15:
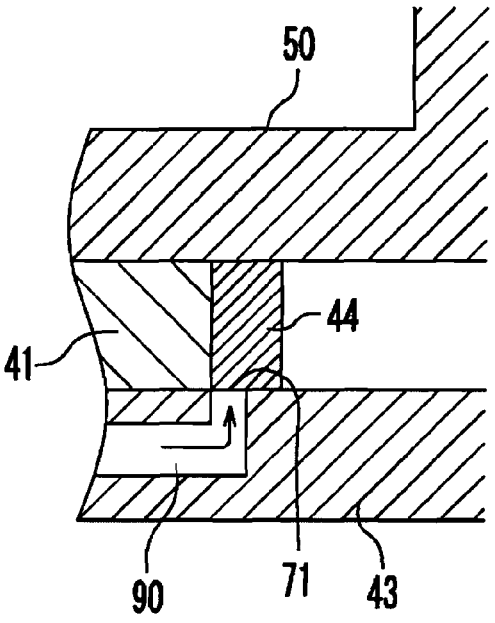
FIG. 15 is a vertical cross-sectional view of a part of an expansion mechanism according to a modification.
Figure 16:
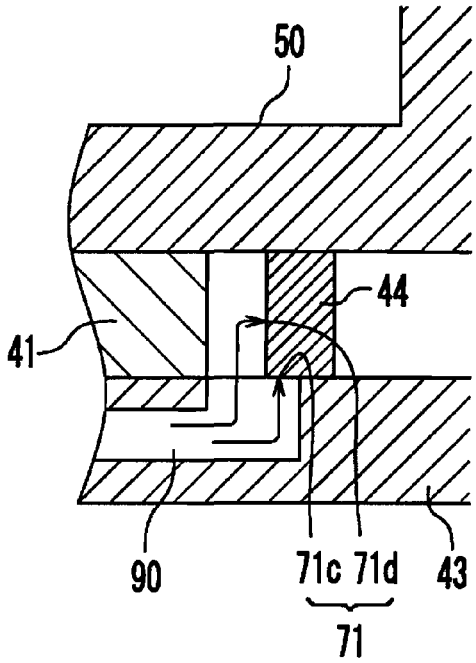
FIG. 16 is a vertical cross-sectional view of a part of an expansion mechanism according to a modification.

In each of the above embodiments, the suction passage 90 is formed in the upper end plate 50. However, as shown in FIG. 14, in the first embodiment, the suction passage 90 may be formed in the intermediate plate 43. As shown in FIG. 15, in the second embodiment, the suction passage 90 may be formed in the intermediate plate 43. In this case, the suction port 71 is formed in the intermediate plate 43, and opens upwardly toward the working chamber in the first cylinder 41. As shown in FIG. 16, in the third embodiment, the suction passage 90 may be formed in the intermediate plate 43. In this case, the suction port 71 is formed to extend over the first cylinder 41 and the intermediate plate 43.

Figure 17:
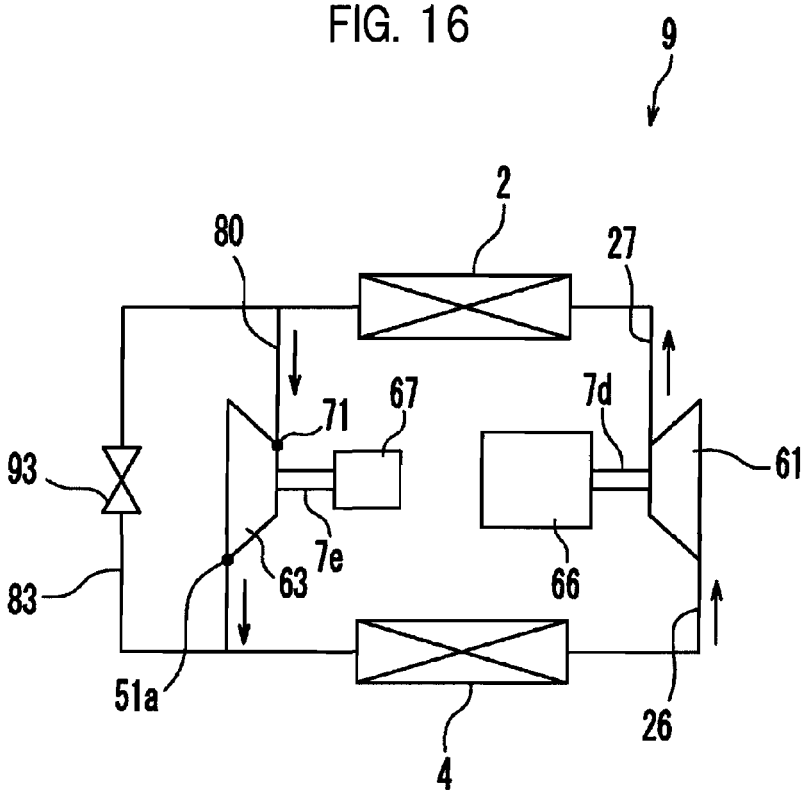
FIG. 17 is a refrigerant circuit diagram of a refrigeration cycle apparatus according to a modification.

In each of the above embodiments, the rotary expander is an expansion mechanism 3 incorporated in the expander-compressor unit 10. The rotary expander is coupled to the compression mechanism 1 via the rotating shaft 7. The rotary expander according to the present invention, however, may be separated from the compressor, or may not be coupled to the compressor. For example, as shown in FIG. 17, the refrigeration cycle apparatus 9 may include a separate compressor 61 and a separate rotary expander 63. The expansion mechanism of the rotary expander 63 is the same as the expansion mechanism 3 of each of the above embodiments. This refrigeration cycle apparatus 9 has almost the same structure as the refrigeration cycle apparatus 9 according to the first embodiment, except that the former includes, instead of the expander-compressor unit 10, a compressor and an expander 63 that are separated from each other, a rotation motor 66 that is connected to the compressor 61 via the rotating shaft 7*d*, and a power generator 67 that is connected to the expander 63 via the rotational shaft 7*e*. The compressor 61 is driven by the rotation motor 66, and in the expander 63, the energy of the expanding refrigerant is converted into electric energy by the power generator 67. This electric energy is used as a part of power for driving the rotation motor 66.

Industrial ApplicabilitY

As described above, the present invention is useful for a two-stage rotary expander, an expander-compressor unit, and a refrigeration cycle apparatus.

The invention claimed is:

1. A two-stage rotary expander comprising:

a first cylinder;

a first closing member for closing one end of the first cylinder;

an intermediate closing member for closing the other end of the first cylinder;

a second cylinder having one end closed by the intermediate closing member;

a second closing member for closing the other end of the second cylinder;

a first piston disposed in the first cylinder to form a first working chamber in the first cylinder together with the first closing member and the intermediate closing member, the first piston being configured to perform an eccentric rotational motion in the first cylinder;

a second piston disposed in the second cylinder to form a second working chamber in the second cylinder together with the intermediate closing member and the second closing member, the second piston being configured to perform an eccentric rotational motion in the second cylinder;

a first partition member for partitioning the first working chamber into an upstream first working chamber and a downstream first working chamber;

a second partition member for partitioning the second working chamber into an upstream second working chamber and a downstream second working chamber;

a suction port facing the upstream first working chamber;

a communication passage formed in the intermediate closing member and having one end facing the downstream first working chamber and the other end facing the upstream second working chamber; and a discharge port facing the downstream second working chamber, wherein the one end of the communication passage is provided at a position located inwardly away from an inner circumferential surface of the first cylinder, and the one end of the communication passage is opened and closed by the eccentric rotational motion of the first piston, so that the one end of the communication passage does not communicate with the downstream first working chamber in communication with the suction port.

2. The two-stage rotary expander according to claim 1, wherein the one end of the communication passage is covered by the first piston during a period from when the first piston closes the one end of the communication passage until when a contact point between the first cylinder and the first piston passes the suction port.

3. The two-stage rotary expander according to claim 2, wherein the one end of the communication passage is approximately elliptical in shape extending in a direction along the inner circumferential surface of the first cylinder.

4. The two-stage rotary expander according to claim 1, wherein the suction port is formed in the first cylinder.

5. The two-stage rotary expander according to claim 1, wherein the suction port is formed in the first closing member or the intermediate closing member.

6. The two-stage rotary expander according to claim 1, wherein the suction port is formed to extend over the first cylinder and the first closing member, or is formed to extend over the first cylinder and the intermediate closing member.

7. An expander-compressor unit comprising:

an expansion mechanism comprising the two-stage rotary expander according to claim 1;

a compression mechanism for compressing a working fluid;

a rotating shaft for coupling the expansion mechanism and the compression mechanism; and a closed casing for accommodating the expansion mechanism, the compression mechanism, and the rotating shaft.

8. The expander-compressor unit according to claim 7, wherein the rotating shaft includes: a first rotating shaft attached to the compression mechanism; and a second rotating shaft coupled to the first rotating shaft and attached to the expansion mechanism.

9. A refrigeration cycle apparatus comprising the expander-compressor unit according to claim 7.

10. A refrigeration cycle apparatus comprising the two-stage rotary expander according to claim 1.

11. The refrigeration cycle apparatus according to claim 10, filled with carbon dioxide as a working fluid.

* * * * *